United States Patent [19]

Yamaoka

[11] Patent Number: 4,850,577

[45] Date of Patent: Jul. 25, 1989

[54] MELTING AND HOLDING FURNACE

[75] Inventor: Masao Yamaoka, Yao, Japan

[73] Assignee: Kabushiki Kaisha Daiki Aluminum Kogyosho, Osaka, Japan

[21] Appl. No.: 206,790

[22] Filed: Jun. 15, 1988

[51] Int. Cl.[4] ..... C22B 9/16

[52] U.S. Cl. ..... 266/229; 266/242

[58] Field of Search ..... 266/200, 212, 900, 901, 266/227, 229, 242, 236

[56] References Cited

U.S. PATENT DOCUMENTS

| | | | |
|---|---|---|---|
| 3,211,546 | 10/1965 | Kozma, Jr. | 266/200 |
| 3,343,828 | 9/1967 | Hunt | 266/212 |
| 4,432,791 | 2/1984 | Jayaraman et al. | 266/901 |

*Primary Examiner*—S. Kastler

*Attorney, Agent, or Firm*—Edwin E. Greigg

[57] ABSTRACT

A melting and holding furnace comprising a melting chamber, a well, and a holding chamber disposed between the melting chamber and the well. The holding chamber includes a plurality of submerged banks projecting from its bottom and extending transversely of a line linking the melting chamber and the well.

3 Claims, 5 Drawing Sheets

MELTING AND HOLDING FURNACE

BACKGROUND OF THE INVENTION

1. Field of the Invention

The present invention relates to an improvement in a melting and holding furnace for processing aluminum and other metals.

2. Description of the Prior Art

In the melting and holding furnace, a raw material of aluminum is fed to a preheating tower, and heated and melted in a melting chamber continuous with the tower. Molten aluminum is then transferred to a holding chamber communicating with the melting chamber, where the molten aluminum is heated by a sustaining burner to be maintained at a selected temperature. The molten aluminum is removed little by little, for casting, from a well communicating with the holding chamber.

The holding chamber of the conventional melting and holding furnace for carrying out the above melting operation has a flat bottom, which entails the following disadvantages:

I. Low-temperature melt flows from the melting chamber to the holding chamber, and from the holding chamber directly into the well. This lowers the melt temperature in the well.

II. As a result of the low-temperature melt flowing from the melting chamber to the holding chamber, iron, silicon and other substances are deposited in the holding chamber. These substances flow into the well and mix into products to form hard spots or otherwise impair the product quality.

III. The melt immediately after leaving the melting chamber contains a large amount of gas such as hydrogen gas. Castings formed of such melt have a high fraction defective.

SUMMARY OF THE INVENTION

The present invention has been made considering the disadvantages of the prior art as noted above. An object of the invention, therefore, is to provide a melting and holding furnace which is effective to prevent lowering of the melt temperature in the well and to check lowering of the product quality due to the deposits and oxides mixing into the product.

In order to achieve the above object, a melting and holding furnace according to the present invention comprises a melting chamber, a well, a holding chamber disposed between the melting chamber and the well, and a plurality of submerged banks projecting from a bottom of the holding chamber and extending transversely of a line linking the melting chamber and the well.

This furnace performs the following functions:

(1) Aluminum raw material fed into a preheating tower is melted in the melting chamber continuous with the tower.

(2) Molten material formed in the melting chamber is allowed to flow into the holding chamber. At this time the molten material is at a low temperature immediately above its boiling point.

(3) The molten material is heated to a selected temperature by a sustaining burner. While being heated, the molten material flows zigzag along the submerged banks in the holding chamber and toward the well.

(4) In the course of such movement, the molten material releases gases and leaves deposits along the banks, whereby the molten material as stabilized is supplied to the well.

(5) The stabilized molten material is removed little by little from the well to be used for casting.

These functions produce the following effects. Since the holding chamber between the melting chamber and the well includes a plurality of submerged banks projecting from its bottom and extending transversely of a line linking the melting chamber and the well, the metal melted in the melting chamber and entering the holding chamber flows zigzag along the banks in the holding chamber. During this movement, the occluded gas is released to stabilize the melt before its entry into the well. Oxides such as $Al_2O_3$ are prevented from mixing into products.

Deposits from the low-temperature melt immediately after its formation are left along the submerged banks without flowing into the well. Further, the banks prevent the low-temperature melt immediately after its formation from flow directly into the well. Instead, the melt is heated to a selected temperature while flowing zigzag along the banks. This results in no lowering of the melt temperature in the well. These features greatly contribute to improvement in the product quality. In addition, the melt weight in the holding chamber is the less for the presence of the submerged banks, thereby to reduce an area for exposure to the heat. As a result, the holding chamber may be formed compact, which in turn allows the entire furnace to be compact.

Another object of the present invention is to allow the melt to flow zigzag smoothly by forming cutouts at mutually remote ends, in plan view, of the plurality of submerged banks.

A further object of the invention is to prevent slag from flowing from the melting chamber to the holding chamber.

Other objects and advantages of the present invention will be apparent from the following description.

BRIEF DESCRIPTION OF THE DRAWINGS

The drawings illustrate melting and holding furnaces embodying the present invention, in which.

DETAILED DESCRIPTION OF THE PREFERRED EMBODIMENTS (First Embodiment)

Figure 1:
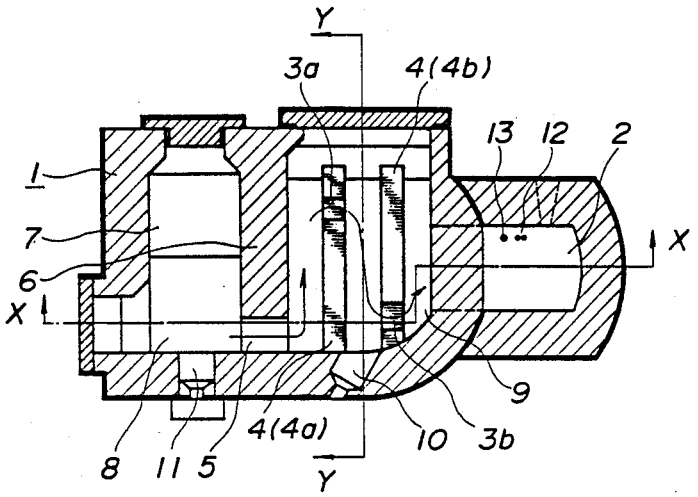
FIG. 1 is a sectional plan view of a melting and holding furnace according to a first embodiment of the invention.
Figure 2:
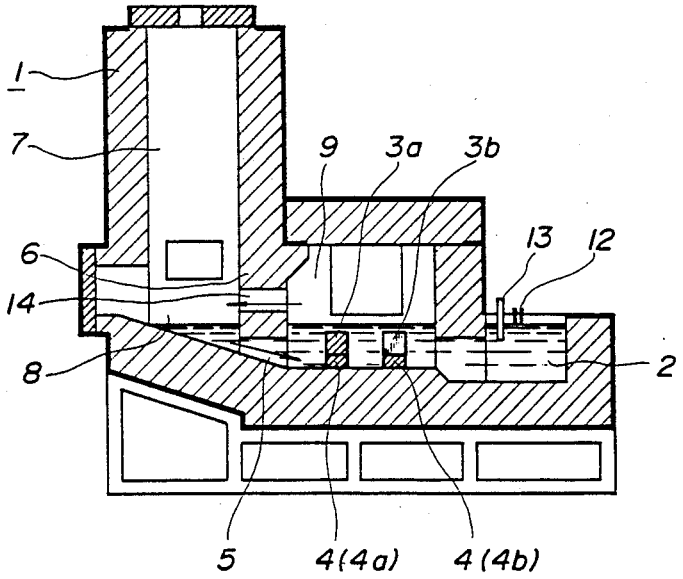
FIG. 2 is a section taken on line Y—Y of FIG. 1.
Figure 3:
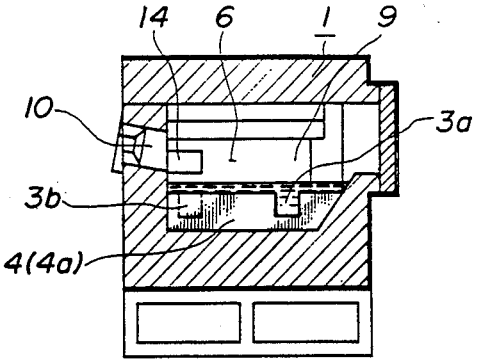
FIG. 3 is a section taken on line X—X of FIG. 1.
Figure 4:
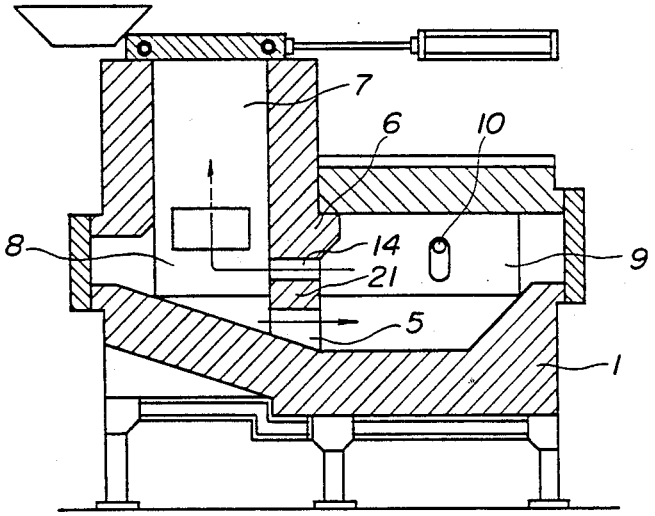
FIG. 4 is a front view in vertical section of a melting and holding furnace according to a second embodiment.
Figure 5:
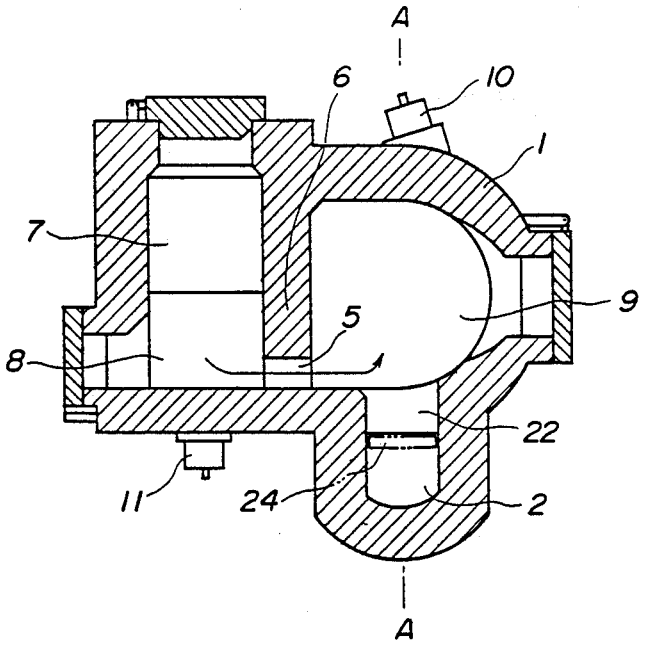
FIG. 5 is a plan view in cross section of the furnace of FIG. 4.
Figure 6:
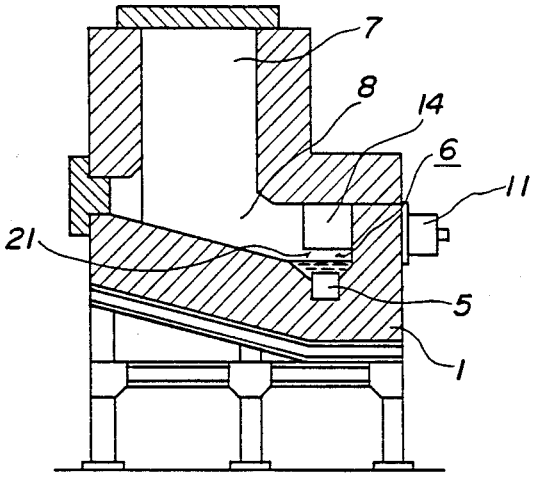
FIG. 6 is a side view in vertical section of the furnace of FIG. 4.

The invention will be described further with reference to FIGS. 1 through 3. The melting and holding furnace shown therein comprises a preheating tower 7, a melting chamber 8 continuous with the bottom of preheating tower 7, a holding chamber 9 communicating at its bottom with the melting chamber 8, and a well 2 communicating at its bottom with the holding chamber 9. The holding chamber 9 has a sustaining burner 10 for producing a flame at an angle to the holding chamber 9, so that the flame moves round in the holding chamber 9 and flows into the melting chamber 8. The melting chamber 8 includes a melting burner 11 for producing a flame straight into the melting chamber 8. The well 2 includes a melt level detector 12 and a temperature sensor 13. The holding chamber 9 further includes a plurality of (two, in this embodiment) submerged banks 4 projecting from the bottom and extending transversely of a line linking the melting chamber 8 and well 2. The first bank 4*a*, which is the closer to the melting chamber 8, defines a first cutout 3*a* at an end opposite, in plan view, to a melt inlet 5 between the melting chamber 8 and holding chamber 9. The second bank 4*b* defiens a second cutout 3*b* at an end thereof remote from the first cutout 3*a*. This construction allows the melt to flow zigzag through the holding chamber 9. Further, a hot blast opening 14 is defined upwardly of the melt inlet 5, and a partition wall 6 is provided between the hot blast opening 14 and the melt inlet 5.

Next, an aluminum melting operation will be described by way of example. The embodiment of course is not limited to the melting of aluminum. The sustaining burner 10 directs a flame into the holding chamber 9, so that the flame circles in the holding chamber 9 and maintains molten aluminum at a selected temperature in the holding chamber 9. After circling in the holding chamber 9 the flame 9 flows as a hot exhaust gas through the hot blast opening 14 defined in the partition wall 6 between the holding chamber 9 and the melting chamber 8. The hot gas entering the melting chamber 8 preheats or melts aluminum raw material in the melting chamber 8. The aluminum raw material is fed into the preheating tower 7 at appropriate times as molten aluminum is removed from the furnace. The raw material thus fed into the preheating tower 7 is preheated or melted by the hot exhaust gas flowing from the melting chamber 8 through the preheating tower 7. The raw material is melted in the melting chamber 8 as described, and the melting burner 11 is lit as necessary when the heat is not sufficient or when the melting operation must be carried out quickly. The resulting molten aluminum flows into the holding chamber 9 through the melt inlet 5 at the bottom of the partition wall 6, and into the well 2 after flowing zigzag along the banks 4 in the holding chamber 9. Fresh melt immediately after its formation, whether through direct contact with the flame or through immersion, occludes a large amount of gas such as hydrogen gas. Such occluded gas is released during a long residence time of the melt in the holding chamber 9, whereby the melt becomes stabilized before entry into the well 2. Further, the melt immediately after its formation is at a low temperature just above the melting point, which produces deposits of iron, silicon and so forth on the bottom of the holding chamber 9. However, these deposits are prevented by the banks 4 from flowing into the well 2. Further, the low-temperature melt immediately after its formation flows zigzag along the banks 4 instead of flowing straight into the well 2, whereby the melt is heated to the selected temperature. Thus, there is no lowering of the melt temperature in the well 2.

The melt in the holding chamber 9 has the less weight because of the presence of the banks 4, which results in a reduced area for exposure to the heat.

(Second Embodiment)

A melting and holding furnace according to a different embodiment of the invention will be described hereinafter with reference to FIGS. 4 through 9. In the following description, the plurality of submerged banks are not referred to in order to avoid repetition, and like components are labeled with like reference numbers.

The melting and holding furnace 1 comprises a preheating tower 7, a melting chamber 8 continuous with the bottom of preheating tower 7, a holding chamber 9 communicating at its bottom with the melting chamber 8, and a well 2 communicating at its bottom with the holding chamber 9. Number 6 indicates a partition wall between the melting chamber 8 and the holding chamber 9. The partition wall 6 defines a hot blast opening 14 upwardly of the surface of melt, a communicating bore 5 below the melt surface, and a slag barrier portion 21 between the hot blast opening 14 and the communicating bore 5. The holding chamber 9 has a sustaining burner 10, and the melting chamber 8 has a melting burner 11. The sustaining burner 10 produces a flame which moves round in the holding chamber 9 to maintain molten aluminum at a selected temperature in the holding chamber 9. The resulting exhaust gas flows as hot blasts into the melting chamber 8 through the hot blast opening 14 defined in the partition wall 6 between the holding chamber 9 and melting chamber 8, to heat aluminum raw material in the melting chamber 8. Molten aluminum flows into the holding chamber 9 through the communicating bore 5 at the bottom of the partition wall 6. The aluminum raw material is fed into the preheating tower 7 at appropriate times as molten aluminum is removed from the furnace. The raw material thus fed into the preheating tower 7 is preheated by the hot exhaust gas flowing from the melting chamber 8 through the preheating tower 7. The raw material is melted in the melting chamber 8 as described, and the melting burner 11 is automatically lit as necessary when the heat is not sufficient or when the melting operation must be carried out quickly. The resulting molten aluminum is maintained at the selected temperature in the holding chamber 9 from flowing into the well 2. Although the above description has been made in relation to a raw material of aluminum raw, this furnace of course can handle other materials as well.

Figure 7:
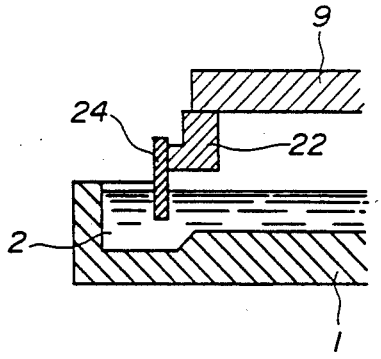
FIG. 7 is a section taken on line A—A of FIG. 5 showing a skim damper.

Referring to FIG. 7, the well 2 and the holding chamber 9 have a boundary wall 22 therebetween above the melt surface, and a skim damper 24 vertically movable along the boundary wall 22. The skim damper 24 is raised above the melt surface when, for example, the furnace must be put to an idle run after weekends or holidays to raise the temperature in the holding chamber 9 quickly, when oxides adhering to the lower edge of skim damper 24 are cleaned, or when the molten metal in the well 2 becomes cool as a result of a rise in the melt surface after start of a melting operation which stops the flame extending to the well 2. The skim damper 24 is raised on such occasions to allow the flame to enter the holding chamber 9 from the well 2, the oxides to be cleaned or the flame to extend to the well 2. Conversely, the skim damper 24 is lowered to be immersed about 2cm from the melt surface for a normal operation. The melt surface level is variable during the normal operation as the melt is removed from the well 2. The skim damper 24 may be vertically moved to accommodate such variations, whereby the skim damper 24 is immersed to a constant depth to assure a reliable operation.

Where, as in the prior art, the boundary wall 22 is the fixed type, a rise in the melt level results in the immersion of the lower edge of the boundary well 22, which stops the flame extending to the well 2 thereby lowering the melt temperature in the well 2. It is important to allow the flame to extend to the well 2 in an initial stage of the melting operation.

As described above, the sustaining burner 10 of the holding chamber 9 maintains the molten metal at the selected temperature in the holding chamber 9. The resulting exhaust gas flows as hot blasts from the holding chamber 9 to the melting chamber 8 through the hot blast opening 14 defined in the partition wall 6 between the holding chamber 9 and the melting chamber 8, to heat the aluminum raw material in the melting chamber 8. Molten aluminum flows from the melting chamber 8 to the holding chamber 9 through the communicating bore 5 at the bottom of the partition wall 6. The surface of the molten aluminum is constantly kept back since the melt surface is on the same level as the slag barrier portion 21. Consequently, slag floating on the melt surface inside the melting chamber 8 is prevented from entering the holding chamber 9.

Figure 8:
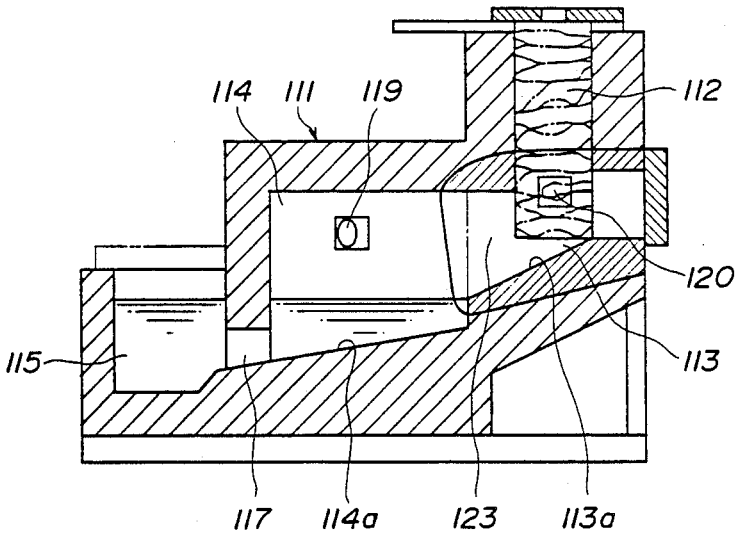
(Prior Art) Fig. 8
FIGS. 8 and 9 are a front view in vertical section and a plan view in cross section of a prior art example for comparison with the furnaces of the present invention.
Figure 9:
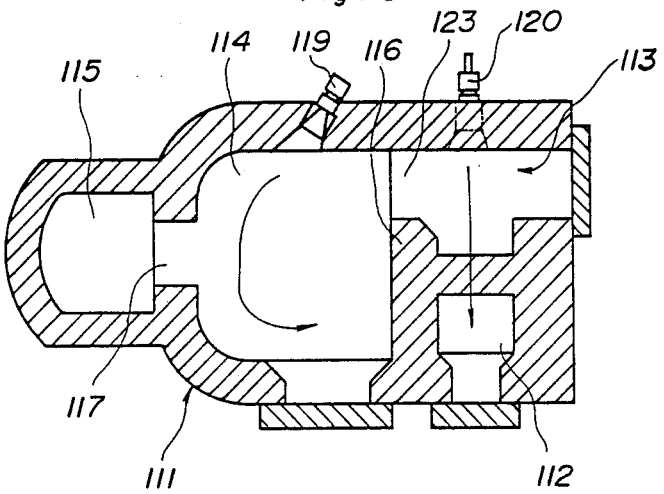
(Prior Art) Fig. 9

The melting and holding furnace according to this embodiment which functions as noted above is capable of eliminating the disadvantage of a known melting and holding furnace (disclosed in Japanese Patent Publication No. 62-23234) as shown in FIGS. 8 and 9.

The melting and holding furnace shown in FIGS. 8 and 9 as a comparative example, which is referenced 111, comprises a preheating chamber 112 for preheating a material fed through a material feed opening, a melting chamber 113 continuous with the preheating chamber 112, a holding chamber 114 communicating with the melting chamber 113 for holding the melt received from the melting chamber 113, and a well 115 communicating with the holding chamber 114 and allowing the melt to be removed from the furnace. Molten aluminum is heated by a sustaining burner 119 to be maintained at a selected temperature, and is removed little by little, for casting, from the well 115 in communication with the holding chamber 114. The melting chamber 113 has a bottom surface 113a stepped to a higher level than the bottom surface 114a of the holding chamber 114. The melting chamber 113 and holding chamber 114 have a partition wall 116 therebetween, which defines a communicating bore 123 to allow the melt to flow from the melting chamber 113 to holding chamber 114. This communicating bore 123 allows hot gas supplied by the sustaining burner 119 to sweep over the surface of molten aluminum when flowing from the holding chamber 114 to the melting chamber 113. This construction, therefore, cannot incorporate a partition between the molten aluminum in the melting chamber 113 and that in the holding chamber 114. Consequently, slag floating on the melt surface in the melting chamber 113 tends to flow into the holding chamber 114 to contaminate the molten aluminum therein, and to flow into the well 115 through a communicating bore 117.

The above disadvantage of the prior art is now totally eliminated by the second embodiment of the present invention. The invention provides further advantages as set out hereunder.

As described, the melting chamber for melting the material and the holding chamber for maintaining the molten material at a selected temperature, have a partition wall therebetween which defines a communicating bore below the melt surface for allowing the melt to flow from the melting chamber to the holding chamber, a hot blast opening above the melt surface for allowing hot blasts to flow from the holding chamber to the melting chamber, and a slag barrier portion between the hot blast opening and the communicating bore. Thus, slag floating on the molten metal is kept back by the slag barrier portion of the partition wall without flowing into the holding chamber, whereby the holding chamber receives and maintains clean melt. No flow of slag into the well results in an improvement in the quality of melt to allow production of excellent castings. Furthermore, the flame delivered by the sustaining burner maintains the melt at a fixed temperature in the holding chamber, and the resulting hot blasts flow through the hot blast opening into the melting chamber and then through the preheating tower. Such movement of the flame quickly preheats the material fed into the furnace and expedites its melting in the melting chamber.

The described embodiments are not limitative, but the invention should be understood to have a scope as defined by its technical concept and the appended claims.

What is claimed is:

1. A melting and holding furnace comprising a melting chamber in which material is melted, a well, a holding chamber disposed between said melting chamber and the well in which a molten material is maintained at a selected temperature; a partition wall disposed between said melting chamber and said holding chamber, a plurality of submerged banks projecting from a bottom of said holding chamber and extending transversely of a line linking said melting chamber and said well, said partition wall defines a communicating bore below a melt surface for allowing molten material to flow from said melting chamber to said holding chamber, and a hot blast opening above said melt surface for allowing hot blast exhaust gases to flow from said holding chamber to said melting chamber, thereby defining a portion between said hot blast opening and said communicating bore which functions as a slag barrier.

2. A melting and holding furnace as claimed in claim 1, further wherein said partition wall disposed between said melting chamber and said holding chamber defines a melt inlet for intercommunicating said melting chamber and said holding chamber, a first submerged bank close to said melting chamber defines a first cutout at an end thereof remote from said melt inlet in plan view, and a second submerged bank disposed next to said first submerged bank defines a second cutout at an end thereof remote from said first cutout, whereby molten material flows zigzag through said holding chamber.

3. A melting and holding furnace as claimed in claim 1, further comprising a boundary wall between said well and said holding chamber, said boundary wall being disposed above said melt surface, and a skim damper vertically movable along said boundary wall.

* * * * *